US010287746B1

(12) United States Patent
Wetta

(10) Patent No.: US 10,287,746 B1
(45) Date of Patent: May 14, 2019

(54) WIDE-FORMAT SWINGING LADDER DREDGE

(71) Applicant: DSC DREDGE, LLC, Reserve, LA (US)

(72) Inventor: William J. Wetta, Reserve, LA (US)

(73) Assignee: DSC DREDGE, LLC, Reserve, LA (US)

( * ) Notice: Subject to any disclaimer, the term of this patent is extended or adjusted under 35 U.S.C. 154(b) by 71 days.

(21) Appl. No.: 15/378,545

(22) Filed: Dec. 14, 2016

Related U.S. Application Data

(60) Provisional application No. 62/267,137, filed on Dec. 14, 2015.

(51) Int. Cl.

| | |
|---|---|
| ***E02F 9/14*** | (2006.01) |
| ***E02F 3/90*** | (2006.01) |
| ***E02F 9/06*** | (2006.01) |
| ***E02F 9/20*** | (2006.01) |
| ***E02F 9/22*** | (2006.01) |
| ***E02F 3/88*** | (2006.01) |

(52) U.S. Cl.
CPC ..... *E02F 3/905* (2013.01); *E02F 3/885* (2013.01); *E02F 9/062* (2013.01); *E02F 9/14* (2013.01); *E02F 9/2016* (2013.01); *E02F 9/22* (2013.01)

(58) Field of Classification Search
CPC ..... E02F 3/8841; E02F 3/905; E02F 9/14
USPC ..... 37/334
See application file for complete search history.

(56) References Cited

U.S. PATENT DOCUMENTS

| | | | | |
|---|---|---|---|---|
| 1,913,670 A * | 6/1933 | Hindes | E02F 3/905 | 37/307 |
| 2,029,815 A * | 2/1936 | Ewing | E02F 3/905 | 114/210 |
| 2,031,388 A * | 2/1936 | Sensibar | E02F 3/181 | 37/326 |
| 2,117,326 A * | 5/1938 | Hutton | E02F 3/081 | 37/334 |
| 2,308,437 A * | 1/1943 | Becker | E02F 3/88 | 37/330 |

(Continued)

FOREIGN PATENT DOCUMENTS

CA 1278798 * 1/1991

*Primary Examiner* — Gary S Hartmann
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A wide format dredge apparatus provides a floating vessel or hull with one or more anchor lines, anchors or spuds that enable an operator to hold the hull in a selected locale. Port and starboard booms extend in generally opposite directions from the hull. An elongated ladder is pivotally attached to the hull. The ladder is configured to swing between port and starboard positions. Port and starboard swing devices are rigged to the booms. When the ladder swings to the port position, the starboard swing device is lengthened and the port swing device is shortened. When the ladder swings to the starboard position, the port swing device is lengthened and the starboard swing device is shortened. Each swing cable spans from a boom at a position spaced away from the hull to the outer end portion of the ladder. A lifting device is provided for raising and lowering the ladder. A float or tank travels along the ladder. The float or tank at least partially supports the ladder.

9 Claims, 4 Drawing Sheets

(56) References Cited

U.S. PATENT DOCUMENTS

| | | | | | |
|---|---|---|---|---|---|
| 2,590,188 | A | * | 3/1952 | Landree | A63H 33/3044 212/243 |
| 2,963,801 | A | * | 12/1960 | Ellicott, Jr. | E02F 3/905 37/331 |
| 3,094,795 | A | * | 6/1963 | Schmidt | B66D 1/08 192/12 R |
| 3,125,819 | A | * | 3/1964 | Kaufmann | E02F 3/907 242/396 |
| 3,146,537 | A | | 9/1964 | Von Bolhar | |
| 3,579,872 | A | | 5/1971 | Jantzen | |
| 3,734,564 | A | | 5/1973 | McKay et al. | |
| 3,739,503 | A | | 6/1973 | Barker et al. | |
| 3,763,580 | A | | 10/1973 | Kuntz, Jr. | |
| 3,777,376 | A | | 12/1973 | Turner et al. | |
| 3,821,859 | A | | 7/1974 | McWatters | |
| 3,902,448 | A | * | 9/1975 | Davis | B63H 19/08 37/346 |
| 3,956,834 | A | | 5/1976 | McWatters | |
| 4,102,064 | A | | 7/1978 | Pot | |
| 4,242,816 | A | | 1/1981 | Jeanson | |
| 4,445,290 | A | | 5/1984 | Oules | |
| 4,597,201 | A | | 7/1986 | Holekamp | |
| 5,617,654 | A | | 4/1997 | Wetta, II | |
| 5,791,074 | A | | 8/1998 | Pryor | |

* cited by examiner

WIDE-FORMAT SWINGING LADDER DREDGE

CROSS-REFERENCE TO RELATED APPLICATIONS

This application claims the benefit of and/or priority to U.S. Provisional Patent Application Ser. No. 62/267,137, filed 14 Dec. 2015, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved swinging ladder dredge apparatus that employs a ladder that is supported by a dredge hull and in part by a floating or flotation traveling tank that pivots with the ladder and wherein the tank travels between ladder end portions as the ladder is raised or lowered. Extension booms are provided on port and starboard sides of the dredge hull. A winch and cable (or fluid operated cylinder) rigged to these extension booms swings the ladder through an arc as the ladder pivots about a gimbal attachment or universal joint on the dredge hull.

2. General Background of the Invention

Dredges are known that employ an elongated boom or ladder with an outer or distal end that is lowered to a water bottom. Equipment on the end of the ladder enables intake of slurried material to be removed. In such prior art dredges, movement of the ladder and its swing are limited, thus limiting digging depth and width. Swinging ladder dredges preferably use cylinders or winches to swing a short boom containing the slurry entrance (ladder) from side to side. The length of the ladder is constrained by the required excavation force and/or the ladder weight.

Patents have issued that are directed to dredge ladders. The following table lists some examples. Each patent in the table is incorporated herein by reference.

TABLE

| Pat. No. | Title | Issued |
|---|---|---|
| 5,791,074 | Dredge | Aug. 11, 1998 |
| 5,617,654 | Dredge Rotary Cutter Head | Aug. 8, 1997 |
| 4,597,201 | Angled Boom Dredge System and Cutterhead Therefor | Jul. 1, 1986 |
| 4,445,290 | Appliance for Dredging the Bottom of a Body of Water | May 1, 1984 |
| 4,242,816 | Dredger Having a Two-Part Boom | Jan. 6, 1981 |
| 4,102,064 | Swell Compensator for Suction Dredging System | Jul. 25, 1978 |
| 3,956,834 | Dredge Ladder Shock Mounting Arrangements | May 18, 1976 |
| 3,821,589 | Dredge Ladder Shock Mounting Arrangements | Jul. 2, 1974 |
| 3,777,376 | Articulated Ladder Construction for Cutterhead Dredge | Dec. 11, 1973 |
| 3,763,580 | Apparatus for Dredging in Deep Ocean | Oct. 9, 1973 |
| 3,739,503 | Hydraulic Dredge Having Articulated Ladder and Swell Compensator | Jun. 19, 1973 |

TABLE-continued

| Pat. No. | Title | Issued |
|---|---|---|
| 3,734,564 | Endless Bucket Dredge with Articulated Ladder and Swell Compensator | May 22, 1973 |
| 3,579,872 | Dredging Apparatus with Surge Compensating Means | May 25, 1971 |
| 3,146,537 | Floating Dredge Design | Sep. 1, 1964 |

BRIEF SUMMARY OF THE INVENTION

The present invention provides an improved dredge apparatus that enables the use of a long boom to provide wide swings and deeper digging depths without a loss in dredge stability or cutting forces. The present invention preferably employs a set of swing booms to provide better swing cable geometry and additional transverse stability or flotation. The booms preferably allow sufficient swing forces, through a series of sheaves, to be applied for nearly any cutter force required.

To negate the healing and trimming moment generated by the longer ladder (flotation instability), the present invention preferably incorporates a traveling flotation tank that is connected to the dredge ladder. This tank preferably travels with the ladder and moves axially (along the ladder) as the ladder is lowered and raised through a series of lift sheaves. The movement of the traveling tank is preferably a function of geometry and not an automated control system.

The wide-format swinging ladder dredge of the present invention includes a floating equipment platform (or hull) having foundations or attachments for most components. A system of spuds or cables preferably anchors or holds this platform from translating or rotating while dredging. A dredge ladder pivot or pivotal or articulating connection is preferably provided called a gimbal. The gimbal enables the ladder to pivot from side to side and also to raise and lower. The gimbal is thus a structure that enables the ladder to move left to right or from port to starboard and also to move from a generally horizontal position at the water's surface to a downward position where it is inclined, the outer or free end of the ladder being movable to the water bed that is to be dredged. A swinging dredge ladder preferably contains piping to transport slurry with or without an excavation device and additional pumping devices. Swing winches, cables, and sheaves with or without swing cylinders are preferably provided to swing the ladder from side to side and through an arc. Foldable swing booms with or without sheaves preferably stabilize the dredge and allow for proper swing forces. The apparatus provides ladder lift winch(s) and cylinder(s) to lift the ladder and/or hold the ladder at a desired, proper depth. A traveling flotation tank with lift frame preferably supports the ladder weight. Ladder lift rigging includes lift cable(s), sheaves, and chains to properly position the traveling tank and lift the ladder.

The present invention preferably includes a wide format dredge apparatus, comprising a hull, one or more spuds, port and starboard booms that preferably extend in generally opposite directions from the hull, an elongated ladder preferably pivotally attached to the hull, said ladder being configured to swing between port and starboard positions, port and starboard swing devices preferably rigged to the booms, wherein when the ladder swings to the port position, the starboard swing device is preferably lengthened and the port swing device is shortened, wherein when the ladder swings to the starboard position, the port swing device is preferably lengthened and the starboard swing device is shortened.

The present invention preferably includes a wide format dredge apparatus, comprising a hull, one or more spuds, port and starboard booms that preferably extend in generally opposite directions from the hull, an elongated ladder preferably pivotally attached to the hull, said ladder being configured to swing between port and starboard positions, port and starboard swing devices rigged to the booms, wherein when the ladder swings to the port position, the starboard swing device is preferably lengthened and the port swing device is shortened, wherein when the ladder swings to the starboard position, the port swing device is preferably lengthened and the starboard swing device is shortened, and wherein each swing cable preferably spans from a said boom at a position spaced away from the hull to the outer end portion of the ladder. The invention further comprises a lifting device for preferably raising and lowering the ladder, and a float that preferably travels along the ladder and that at least partially supports the ladder.

In one embodiment, each swing device can be a hydraulic cylinder.

In one embodiment, each swing device can be a winch and winch cable.

In one embodiment, one or more swing devices can be a winch and winch cable, and/or one ore more swing devices can be a hydraulic cylinder.

In one embodiment, the booms preferably fall along a common line.

In one embodiment, the float travels toward the hull when the ladder is preferably lowered and away from the hull when the ladder is preferably raised.

In one embodiment, the cables can preferably be shortened or lengthened to compensate when the ladder is preferably raised or lowered and the ladder is preferably centered in between the booms.

In one embodiment, the swing devices can be attached to the ladder nearer to the outer end of the ladder.

In one embodiment, the swing devices can be attached to the ladder at the outer end of the ladder.

In one embodiment, the float can extend laterally to port and starboard sides of the ladder.

In one embodiment, the ladder is preferably pivotal relative to the hull through an arc of about 90 degrees.

In one embodiment, the present invention can further comprise one or more supports that preferably span between each boom and the hull aft of the boom.

The present invention preferably includes a wide format dredge apparatus, comprising a hull, anchors for preferably holding the hull in a selected position, port and starboard booms that each preferably extend laterally away from the hull, an elongated ladder preferably pivotally attached to the hull, said ladder being configured to swing about a hull mounted pivot between port and starboard positions, port and starboard swing devices preferably rigged to the booms, wherein each swing cable spans from a said boom at a position spaced away from the hull to the outer end portion of the ladder, a lifting device for preferably raising and preferably lowering the ladder, a float that travels along the ladder and that preferably at least partially supports the ladder, wherein each swing cable preferably spans from a said boom at a position spaced away from the hull to the outer end portion of the ladder. Further comprising a lifting device for preferably raising and preferably lowering the ladder, and a float that preferably travels along the ladder and that at least partially supports the ladder.

In one embodiment, each swing device is preferably a hydraulic cylinder.

In one embodiment, each swing device preferably includes one or more winches and winch cables.

In one embodiment, each of the booms preferably form an acute angle with a said boom when the ladder is closest to the said boom.

In one embodiment, the float preferably travels toward the hull when the ladder is lowered and away from the hull when the ladder is raised.

In one embodiment, the device can preferably be shortened or lengthened to compensate when the ladder is preferably raised or lowered and the ladder is preferably centered in between the booms.

In one embodiment, the swing devices preferably attach to the ladder nearer to the outer end of the ladder.

In one embodiment, the swing devices preferably attach to the ladder at the outer end of the ladder.

In one embodiment, the float preferably extends laterally to port and starboard sides of the ladder.

In one embodiment, the ladder is preferably pivotal relative to the hull through an arc of between about 90 degrees.

In one embodiment, the present invention can further comprise one or more supports that preferably span between each boom and the hull aft of the boom.

The present invention preferably includes a wide format dredge apparatus, comprising a hull, anchors for preferably holding the hull in a selected position, port and starboard booms that each preferably extend laterally away from the hull, an elongated ladder preferably pivotally attached to the hull, said ladder being configured to swing about a hull mounted pivot between port and starboard positions, port and starboard swing devices preferably rigged to the booms, wherein each swing device preferably spans from a said boom at a position spaced away from the hull to the outer end portion of the ladder, a lifting device for preferably raising and lowering the ladder, and a float preferably attached to the ladder and that at least partially supports the ladder.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
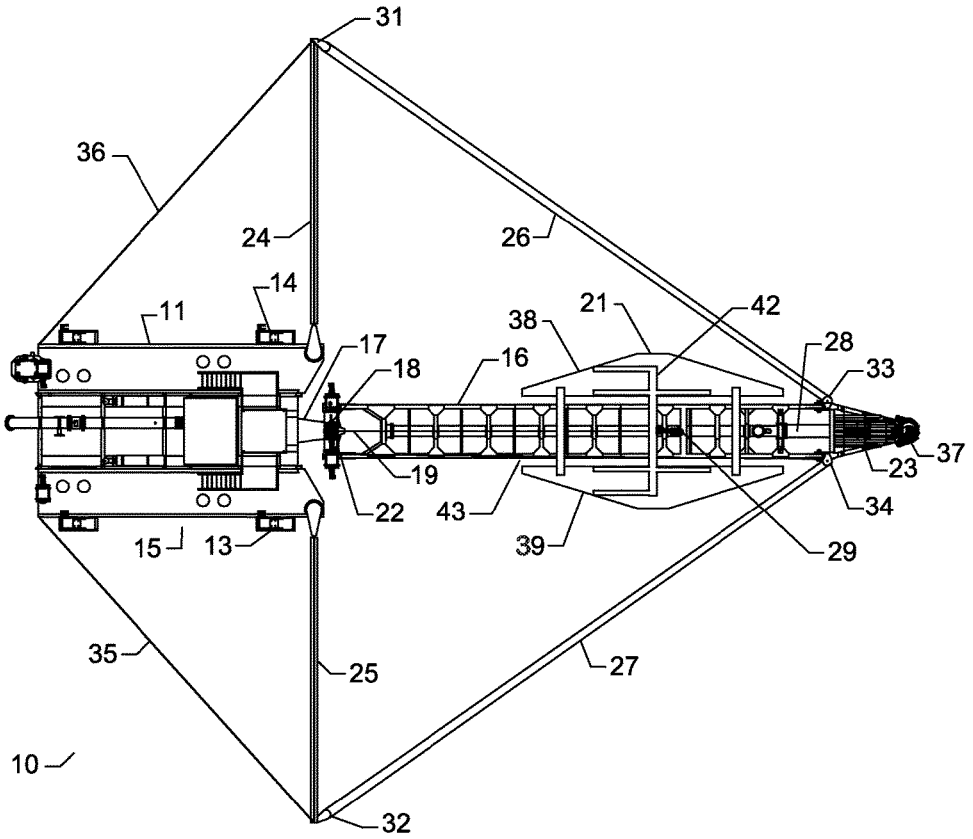
FIG. 1 is a plan view of a preferred embodiment of the apparatus of the present invention.
Figure 2:
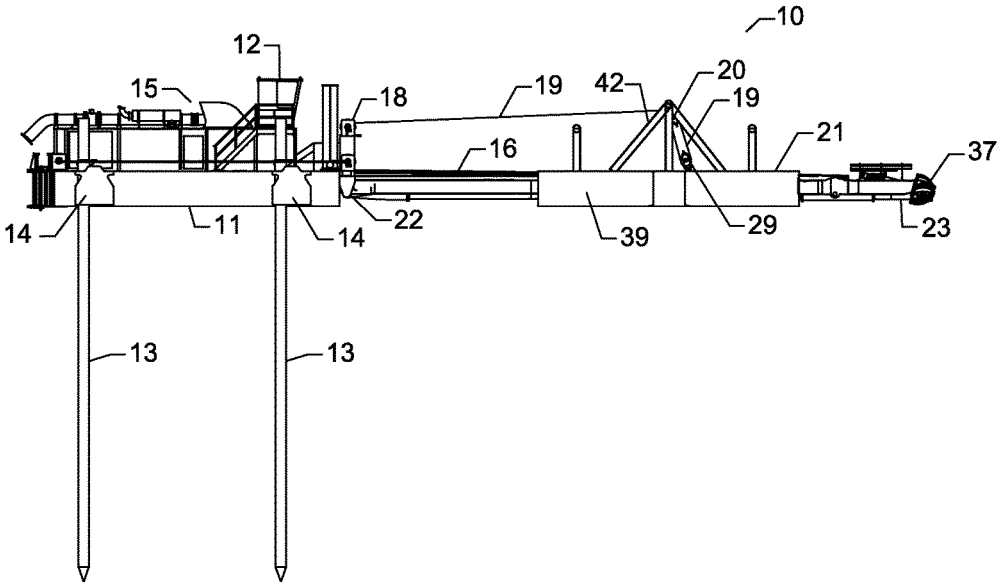
FIG. 2 is an elevation view of a preferred embodiment of the apparatus of the present invention.

FIG. 1 shows a plan view of a dredge apparatus 10 of the present invention in a non-dredging position. In FIGS. 1, 2 ladder 16 is raised and centered. FIGS. 1-2 show a normal position to begin dredging operation. FIG. 2 shows the outboard profile or side view of the dredge 10 in the non-dredging position.

In FIGS. 1 and 2, the dredge hull or flotation tank 11 is preferably held in position by a plurality of (e.g., four) spuds 13. Typically at least two spuds 13 or three anchor cables are preferably required to keep the dredge 10 in the proper position. Additional spuds 13 or cables may be used to embrace or automate the hull or dredge tank 11 movement. Hull 11 can provide a pilot house 12 for an operator and a pump or pumping apparatus 15.

Figure 4:
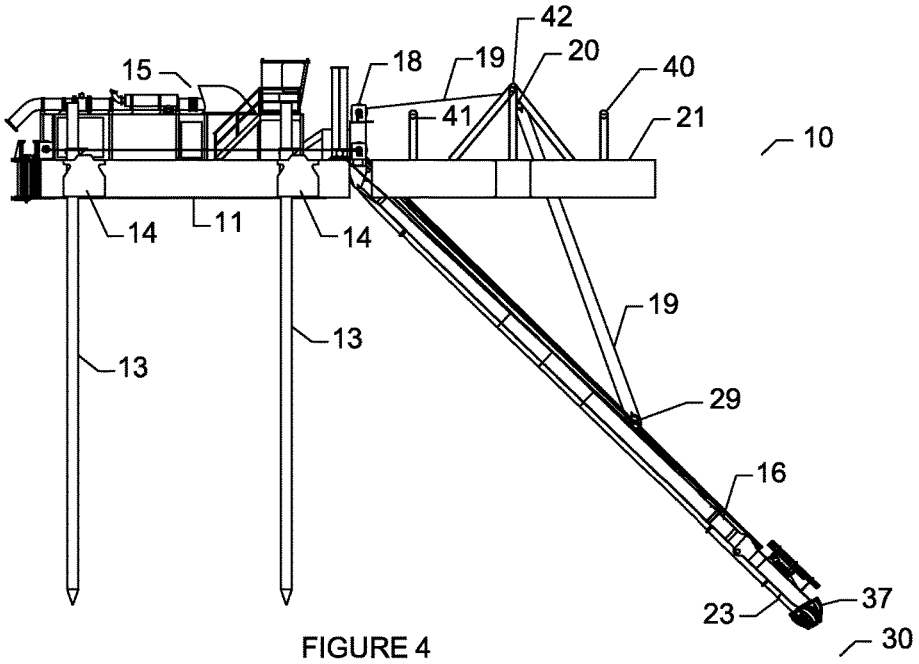
FIG. 4 is an elevation view of a preferred embodiment of the apparatus of the present invention with the ladder lowered.

Using swing winches and/or swing cylinders mounted on ladder 16 or hull 11, the dredge ladder 16 can be swung to one side (see FIG. 6) to begin the dredging process. To begin dredging, ladder 16 is preferably lowered to the water bottom 30 by ladder lift winch(s) 18 and cable or lift cylinder(s) 19 as shown in FIG. 4. The ladder 16 preferably supports a ladder slurry pipe 28 that is used to intake sediment to be removed. Ladder 16 and slurry pipe 28 can be fitted with a rotary cutter head 37 (e.g., see U.S. Pat. No. 5,617,654 issued to Wetta and incorporated herein by reference). With the ladder slurry pipe 28 near the water bottom 30, the dredge swing winches preferably rotate the dredge ladder 16 through an arc of about ninety degrees to a desired position on the opposite side. One swing winch preferably pulls the dredge ladder 16 across the bottom as the other swing winch preferably releases winch cable as needed. This operation is preferably repeated with the ladder 16 being lowered until the desired depth is achieved. Once the depth is reached, the dredge hull 11 can be repositioned using the spuds 13, or a cable and anchor system, and then can remove more sediment from water bottom 30.

Dredge apparatus 10 has a hull or floating tank 11 that preferably supports various dredge components such as pilot house 12 and pump 15 or pumping equipment used to suction material (or sediment) from a water bottom. A plurality of spuds 13 can be provided. Each spud 13 can be raised or lowered with a lift mechanism such as actuator or mechanism 14 (e.g., a winch and cable, or hydraulic cylinder). A ladder 16 is preferably coupled to hull or tank 11 at a pivot or pivotal connection or gimbal 17 (or other articulating connection). Ladder 16 has inner end 22 that preferably attaches to hull or tank 11 at pivot/pivotal connection 17. Ladder 16 has outer end 23 that is preferably lowered to a water bottom 30 during dredging. Ladder 16 can be raised or lowered using lifting winch (or winches) 18 and lifting cable (or cables) 19. Lifting cable 19 can include fixed or stationary block 20 and traveling block 29.

Figure 3:
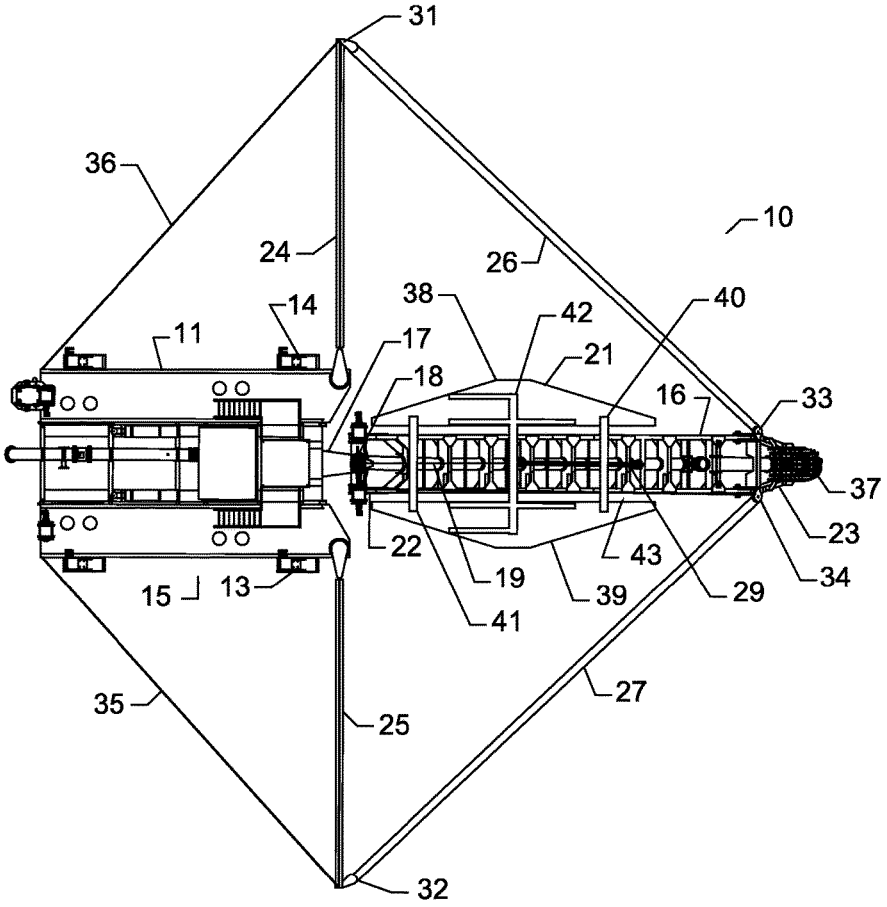
FIG. 3 is a plan view of a preferred embodiment of the apparatus of the present invention with the ladder lowered.

Traveling tank or float 21 preferably moves along ladder 16 to provide support. The traveling tank 21 is preferably buoyant and floats over the ladder 16 and supports its weight so that the ladder can be longer and wider. For example, the ladder 16 can be longer than the hull 11 as seen in FIGS. 1-4. The traveling tank 21 can have two sections or segments such as a traveling tank port section 38 and a traveling tank starboard section 39. These traveling tank sections 38, 39 can be connected with one or more arches or beams such as, for example, front arch 40 and rear arch 41. Cable support 42 can span between the tank sections 38, 39 as seen in FIG. 1. The cable support 42 preferably extends upwardly as seen in FIG. 2. A space 43 is preferably provided in between the tank port and starboard sections 38, 39. The space 43 can be occupied by ladder 16 as seen in FIGS. 1 and 3.

Figure 6:
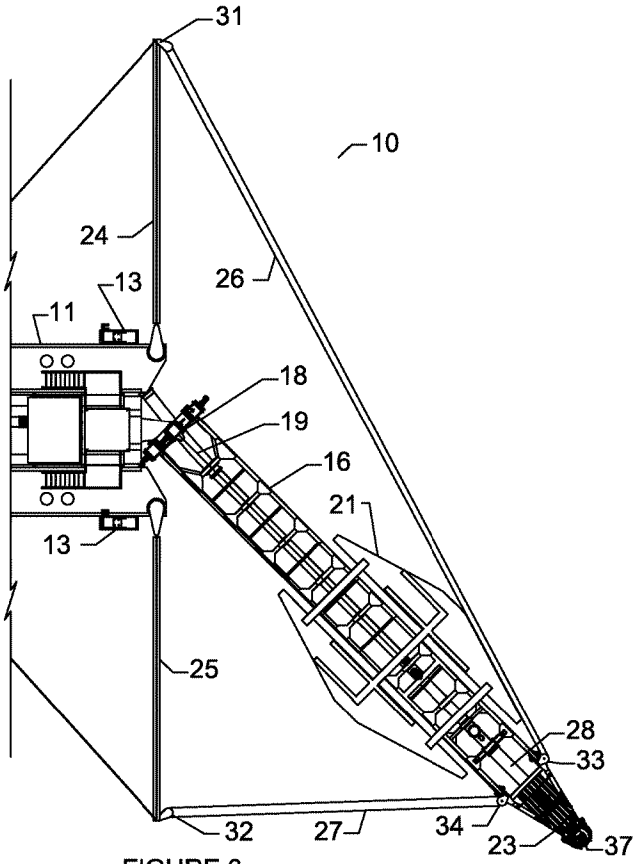
FIG. 6 is a plan view of a preferred embodiment of the apparatus of the present invention showing the ladder after swinging to one side.
Figure 5:
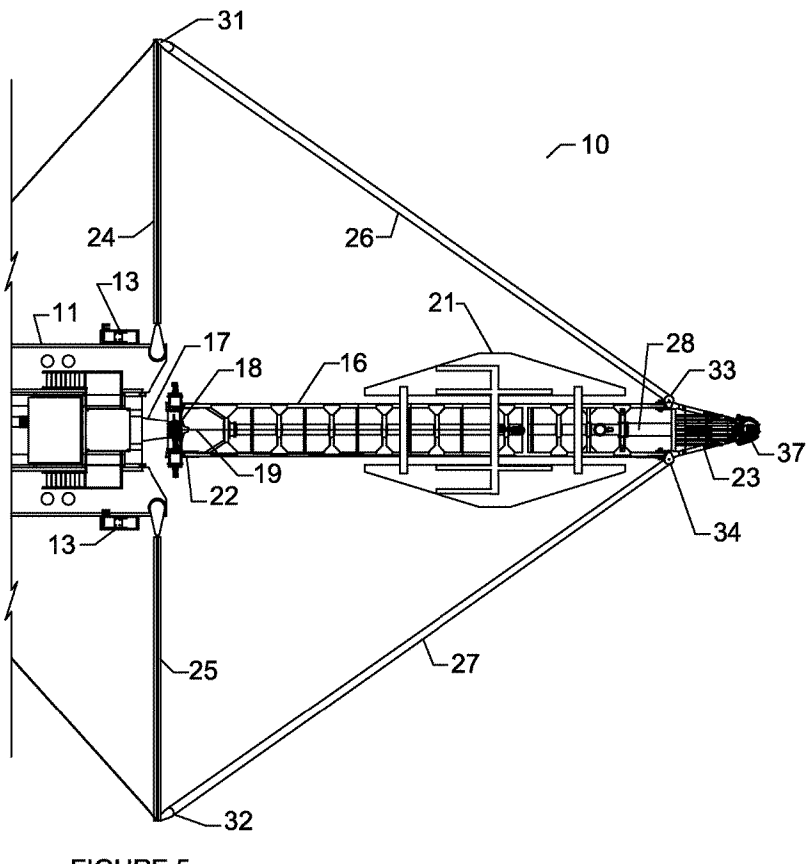
FIG. 5 is a plan view of a preferred embodiment of the apparatus of the present invention with the ladder centered.
Figure 8:
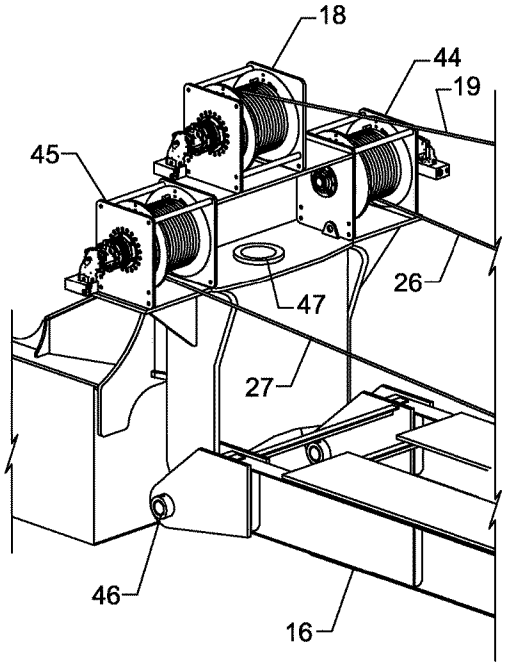
FIG. 8 is a partial perspective view of the preferred embodiment of the apparatus of the present invention showing the gimbal.

Extension booms 24, 25 are preferably attached (e.g., pivotally) to the hull or floating tank 11. Swing cables 26, 27 can be rigged to each extension boom 24, 25. Each cable 26, 27 is preferably powered with a winch. The winches can include a pair of swing winches 44, 45 (see FIG. 8). In one embodiment, these swing winches 44, 45 can be mounted to the gimbal 17, with the swing winch 44 being a port side swing winch and the swing winch 45 being a starboard side swing winch as seen in FIG. 8. Each swing winch 44, 45 is preferably rigged with cabling 26 or 27 as seen in FIGS. 1, 3, 5 and 8. In this fashion, the swing winch 44 pulls the boom or ladder 16 to the port side whereas the swing winch 45 is used to swing the ladder 16 to the starboard side. The cables 26, 27 can thus be used to swing the ladder 16 from one side to the other. In FIG. 6, ladder 16 has been pivoted or swung to a starboard position. Swing cable 26 has been lengthened. Swing cable 27 has been shortened. Ladder 16 can swing, e.g., about ninety degrees, from the position shown in FIG. 6 to a port position by lengthening cable 27 and shortening cable 26. Swinging of ladder 16 from port to starboard (FIG. 6) or from starboard to port can be done when ladder 16 is in the lowered position of FIG. 4 and during dredging when sediment is cut with a cutter 37 and suctioned using ladder slurry pipe 28.

Figure 7:
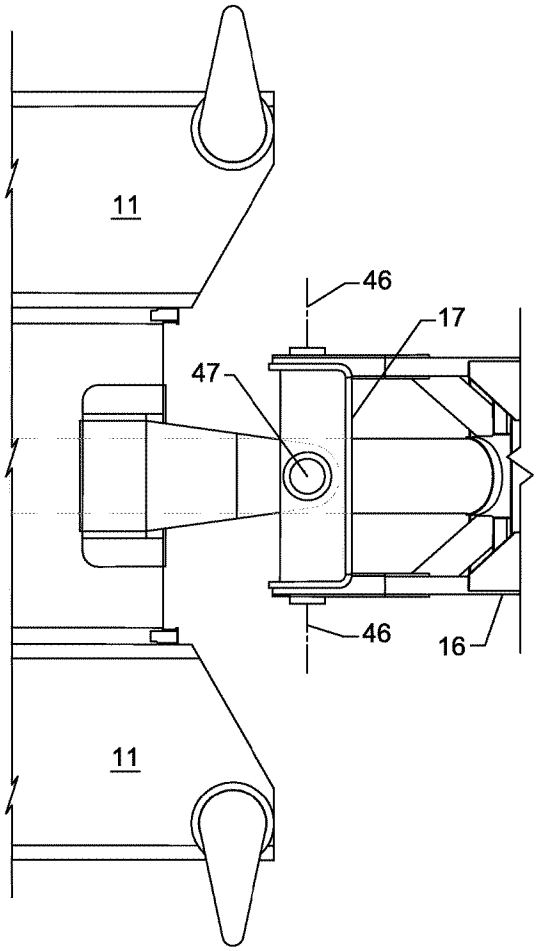
FIG. 7 is a partial plan view of the preferred embodiment of the apparatus of the present invention showing the gimbal.

In FIGS. 7-8, gimbal 17 can have a horizontal axis or pivot at 46 and a vertical axis or pivot at 47. Anchored sheaves 31, 32 preferably are mounted to the outer ends of extension booms 24, 25 as seen in FIGS. 1, 3, 5-6. Winch cables 35, 36 can be rigged to sheaves 31, 32 and to winches on hull 11. Cables 35, 36 become part of swing cables 26, 27 when rigged between an anchored sheave 31 or 32 and a ladder sheave 33 or 34 as seen in FIGS. 1, 3 and 5-6. Ladder sheaves 33, 34 are preferably mounted to outer end 23 of ladder 16 as seen in FIGS. 1, 3 and 5-6. During use, the tank or float 21 moves away from the hull 11 when the ladder or boom 16 is raised as seen in FIGS. 1 and 2. The float or tank 21 moves toward the hull 11 when the ladder or boom 16 is lowered as seen in FIGS. 3 and 4.

The following is a list of parts and materials suitable for use in the present invention:

PARTS LIST:

| PART NUMBER | DESCRIPTION |
|---|---|
| 10 | dredge apparatus |
| 11 | hull/floating tank/flotation tank |
| 12 | pilot house |
| 13 | spud |
| 14 | spud mechanism/lift/actuator |
| 15 | pump/pumping apparatus |
| 16 | ladder/boom |
| 17 | gimbal |
| 18 | ladder lifting winch and cable/lift cylinder |
| 19 | ladder lifting cable/lift cylinder |
| 20 | stationary block |
| 21 | traveling tank/float |
| 22 | inner end |
| 23 | outer end |
| 24 | extension boom |
| 25 | extension boom |
| 26 | swing cable |

-continued

PARTS LIST:

| PART NUMBER | DESCRIPTION |
|---|---|
| 27 | swing cable |
| 28 | ladder slurry pipe |
| 29 | traveling block |
| 30 | water bottom/seabed/river bed/lake bed |
| 31 | anchored sheave |
| 32 | anchored sheave |
| 33 | ladder sheave |
| 34 | ladder sheave |
| 35 | winch cable |
| 36 | winch cable |
| 37 | cutter head |
| 38 | traveling tank port section |
| 39 | traveling tank starboard section |
| 40 | front arch |
| 41 | rear arch |
| 42 | cable support |
| 43 | space |
| 44 | swing winch |
| 45 | swing winch |
| 46 | horizontal axis/pivot |
| 47 | vertical axis/pivot |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A wide format dredge apparatus, comprising:

a) a hull;

b) one or more spuds;

c) port and starboard booms that extend in generally opposite directions from the hull;

d) an elongated ladder movably attached to the hull, said ladder being configured to swing between port and starboard positions and between elevated and lowered positions;

e) port and starboard swing devices rigged to the booms;

f) wherein when the ladder swings to the port position, the starboard swing device is lengthened and the port swing device is shortened;

g) wherein when the ladder swings to the starboard position, the port swing device is lengthened and the starboard swing device is shortened;

h) a float that travels along the boom;

i) a cable or cables rigged to the float and to the boom wherein when the boom is movable between raised and lowered boom positions;

j) wherein in said raised boom position the float moves away from the hull and in said lowered boom position the float moves toward the hull; and k) wherein the float remains in a floating position at the water's surface in both said raised boom position and in said lowered boom position.

2. The dredge apparatus of claim 1 wherein each swing device includes a winch and winch cable wound upon said winch.

3. The dredge apparatus of claim 1 wherein the booms fall along a common line.

4. The dredge apparatus of claim 1 wherein the float extends to opposing sides of the ladder.

5. The dredge apparatus of claim 2 wherein the cables can be shortened or lengthened to compensate for when the ladder is raised or lowered and when the ladder is centered in between the booms.

6. The dredge apparatus of claim 1 wherein the port and starboard swing devices attach to the ladder nearer to an outer end of the ladder.

7. The dredge apparatus of claim 1 wherein the port and starboard swing devices attach to the ladder at an outer end of the ladder.

8. The dredge apparatus of claim 1 wherein the ladder is pivotal relative to the hull through an arc of about 90 degrees.

9. The dredge apparatus of claim 1 further comprising one or more supports that span between each boom and the hull aft of the boom.

* * * * *